United States Patent [19]

Tsubouchi

[11] Patent Number: 4,730,182

[45] Date of Patent: Mar. 8, 1988

[54] COMBINATION HEAT-SENSING FIRE DETECTOR

[75] Inventor: Seiji Tsubouchi, Tokyo, Japan

[73] Assignee: Nittan Company, Tokyo, Japan

[21] Appl. No.: 849,567

[22] Filed: Apr. 8, 1986

[30] Foreign Application Priority Data

Apr. 11, 1985 [JP] Japan ..... 60-52867[U]

[51] Int. Cl.[4] ..... G08B 17/06

[52] U.S. Cl. ..... 340/593; 340/521; 340/589

[58] Field of Search ..... 340/588, 589, 593, 596, 340/521, 522, 584, 598; 337/140

[56] References Cited

U.S. PATENT DOCUMENTS 4,356,478 10/1982 Muggli et al. ..... 340/593

4,381,503 4/1983 Kobayashi ..... 340/589

FOREIGN PATENT DOCUMENTS 0070137 1/1983 European Pat. Off. ..... 340/588

57-27110 2/1982 Japan .

*Primary Examiner*—Glen R. Swann, III

*Assistant Examiner*—Tat K. Wong

*Attorney, Agent, or Firm*—Webb, Burden, Robinson & Webb

[57] ABSTRACT

In a combination heat-sensing fire detector provided with a differential diaphragm electric contact and a contact which operates at a predetermined temperature, a shape memory effect element is used as a device which operates at a predetermined temperature. The fire detector can generate a fire alarm without fail even when the ambient temperature rises very slowly.

2 Claims, 1 Drawing Figure

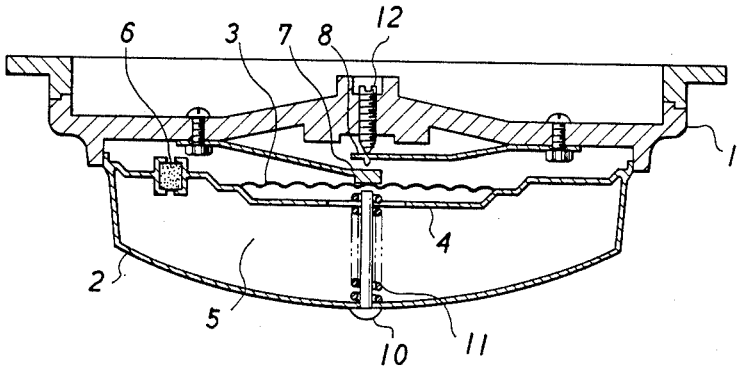
6
3
7
8
12
1
4
2
5
10
11

COMBINATION HEAT-SENSING FIRE DETECTOR

FIELD OF THE INVENTION

This invention relates to a combination heat-sensing fire detector. More particularly, this invention relates to a fire detector provided with a differential diaphragm contact means and a contact means which operates at a predetermined temperature.

BACKGROUND OF THE INVENTION

A fire detector provided with a differential diaphragm contact means and a contact means which operates at a predetermined temperature in combination is known. For instance, Japanese Utility Model Publication No. 57-27110 (1982) discloses a combination heat-sensing fire detector provided with a differential diaphragm contact means and a contact means which operates by the function of a bimetal member in combination.

This fire detector comprises an air chamber composed of cup-shaped heat-sensing plate, a diaphragm support frame covering the opening of the cup-shaped heat-sensing plate and a diaphragm which is secured to the central opening of the diaphragm support frame. The diaphragm support frame is provided with a vent or leak hole which is a pinhole or a small opening packed with a porous material. An electric contact point is provided at the center of the diaphragm so that the contact point is closed when the diaphragm is deformed and displaced outward. In the center of the bottom of the cup-shaped heat-sensing plate are provided a bimetal member which changes from concave to convex when the ambient temperature reaches a predetermined value and a pin which projects toward the center of the diaphragm supported by a pin guide so that, when the bimetal changes convex, the pin pushes the diaphragm outward causing the electric contact to close.

The thus constructed fire detector operates as follows. When the ambient temperature rapidly rises, the air in the air chamber expands, heated by the heat received by the heat-sensing plate. But the leak hole does not allow rapid leakage of the expanded air, and the diaphragm is deformed so as to close the electric contact. In contrast, when the ambient air temperature rises slowly, the expanded air in the air chamber is allowed to gradually leak out through the leak hole, and therefore the diaphragm does not close the electric contact point. However, when the bimetal member is heated, even slowly, to a predetermined temperature, it turns convex and pushes the pin so as to close the electric contact point. Thus the fire detector is able to generate a fire alarm both when the ambient temperature rises slowly and when it rises rapidly.

However, the operation of the bimetal contact is not so accurate and the degree of the deformation thereof is relatively small and therefore precise design and adjustment are required in this conventional combination heat-sensing fire detector.

DISCLOSURE OF THE INVENTION

This invention provides a combination heat-sensing fire detector comprising an air chamber composed of a cup-shaped heat-sensing plate, a diaphragm support frame covering the opening of the cup-shaped heat-sensing plate and a diaphragm which is secured to the central opening of the diaphragm support frame, said air chamber is secured to a base plate of a non-conductive material which can be secured to a ceiling or wall by conventional securing means, wherein the diaphragm support frame is provided with a leak hole which is a pinhole or a small opening packed with a porous material, an electric contact point is provided at the center of the diaphragm so that the contact point is closed when the diaphragm is deformed and displaced outward, a pin made of a material having high thermal conductivity is secured at the center of the heat-sensing plate so as to project toward the center of the diaphragm and a coil made of a shape memory effect alloy the inside diameter of which corresponds to the diameter of the pin and the length of which is at least more than half of the length of the pin is mounted on and surrounding the pin.

The heat-sensing plate is preferably made of a metallic material having high thermal conductivity such as phosphorus bronze, brass, tin plate etc. The base plate can be made of any non-conductive material, but in practice a synthetic resin is suitable. The pin is made preferably of copper. Shape memory effect alloys are now well known and commercially available in a desired shape and with a desired transformation temperature. Therefore, the fire detector of this invention can be manufactured by those skilled in the art by referring to this specification.

In the combination heat-sensing fire detector, a shape memory effect element, which has an accurate and high degree deformation capability at a predetermined temperature, is employed as a means to operate the contact means at a predetermined temperature. Therefore, the fire detector can generate a fire alarm without fail even when the ambient temperature rises very slowly, and precise design and adjustment of the contact point is not required and thus manufacturing thereof is far easier.

BRIEF EXPLANATION OF THE DRAWING

Now the invention will be described in detail with reference to the attached drawing, which is a schematic sectional view of an embodiment of the present invention.

DETAILED DESCRIPTION OF EMBODIMENT

As shown in the drawing, the combination heat-sensing fire detector of this invention comprises an air chamber 5, which is composed of a cup-shaped heat-sensing plate 2 made of copper, for instance, a diaphragm support frame 4 covering the opening of the cup-shaped heat-sensing plate 2 and a diaphragm 3 secured to the central opening of the diaphragm support frame. The air chamber 5 is secured to a base plate 1 made of a synthetic resin, for instance. The base plate 1 can be secured to a ceiling or a wall by a known securing means. The diaphragm support frame 4 is provided with a central opening and a vent or a leak hole 6, which is a small opening packed with a porous material in this embodiment. The diaphragm 3 is made of phosphorus bronze for instance and is secured at the central opening of the diaphragm support frame 4.

At the central part of the diaphragm outside of the air chamber, electric contact means 7 and 8 which are resiliently supported by the base plate 1. The contact means 7 is almost in contact with the diaphragm and other contact means 8 can be adjusted by means of an adjusting screw 12 so that it is a proper distance from the contact means 7.

A pin 10 is secured at the central part of the bottom of the cup-shaped heat-sensing plate 2 by soldering or brazing so that it projects toward the central part of the diaphragm 3, and the upper end of the pin almost contacts the diaphragm. A coil 11 of a shape memory effect alloy, nickel-titanium for instance, the inner diameter of which is almost the same as the diameter of the pin, is mounted on and surrounding the pin 10. The length of the coil 11 is chosen with elongation involved in the transformation taken into consideration. Generally a bidirectional shape memory effect alloy elongates to approximately twice its length at the low temperature when it is heated to the transformation temperature, although the degree of elongation varies depending upon the kind of alloy and the load applied. Therefore, the coil must have a length of at least half of the length of the pin, and preferably almost the same length as the pin.

The thus constructed fire detector of this invention operates as follows. When the ambient temperature rises rapidly, the electric contact is closed by deformation of the diaphragm as explained above with respect to the prior art. When the ambient temperature rises slowly, the differential diaphragm does not work, but as the shape memory effect alloy coil is heated to its transformation point by the heat conducted through the heat-sensing plate 2 and the pin 10, the coil extends so as to close the electric contact means 7 and 8. Thus the fire detector of this invention can generate a fire alarm without fail both when the ambient temperature rises rapidly and when it rises very slowly.

What I claim is:

1. A combination heat-sensing fire detector comprising an air chamber composed of a cup-shaped heat-sensing plate, a diaphragm support frame covering the opening of the cup-shaped heat-sensing plate and a diaphragm which is secured to the central opening of the diaphragm support frame, said air chamber is secured to a base plate of a non-conductive material which can be secured to a ceiling or wall by conventional securing means, wherein the diaphragm support frame is provided with a leak hole which is a pinhole or a small opening packed with a porous material, an electric contact point is provided at the center of the diaphragm so that the contact point is closed when the diaphragm is deformed and displaced outward, a pin made of a material having high thermal conductivity is secured at the center of the heat-sensing plate so as to project toward the center of the diaphragm and a coil made of a shape memory effect alloy the inside diameter of which corresponds to the diameter of the pin and the length of which is at least more than half of the length of the pin is mounted on and surrounding the pin.

2. The combination heat-sensing fire detector as recited in claim 1, wherein the coil element is made of nickel-titanium shape memory effect alloy.

* * * * *